United States Patent [19]

Chance et al.

[11] Patent Number: 4,836,894

[45] Date of Patent: Jun. 6, 1989

[54] PROFILING AIR/STEAM SYSTEM FOR PAPER-MAKING MACHINES

[75] Inventors: James L. Chance, Rockton; Laurie D. Wicks, South Beloit, both of Ill.

[73] Assignee: Beloit Corporation, Beloit, Wis.

[21] Appl. No.: 48,500

[22] Filed: Apr. 27, 1987

Related U.S. Application Data

[63] Continuation of Ser. No. 720,482, Apr. 9, 1985, abandoned, which is a continuation-in-part of Ser. No. 428,565, Sep. 30, 1982, abandoned.

[51] Int. Cl.[4] ..... D21F 3/00; D21F 5/00

[52] U.S. Cl. ..... 162/253; 34/54; 162/206; 162/207; 162/290; 162/DIG. 6

[58] Field of Search ..... 162/252, 253, 198, 206, 162/207, 208, 290, DIG. 6, DIG. 10, 359; 34/34, 54

[56] References Cited

U.S. PATENT DOCUMENTS

| | | | |
|---|---|---|---|
| 3,089,252 | 5/1963 | Daane et al. | 34/34 |
| 3,770,578 | 11/1973 | Spurrel | 162/206 |
| 3,838,000 | 9/1974 | Urbas | 162/290 |
| 4,114,528 | 9/1978 | Walker | 162/253 |
| 4,249,992 | 2/1981 | Wells | 162/198 |
| 4,253,247 | 3/1981 | Bergstrom | 34/34 |
| 4,351,700 | 9/1982 | Dove | 162/252 |
| 4,545,857 | 10/1985 | Wells | 162/290 |
| 4,545,857 | 10/1985 | Wells | 162/290 |

*Primary Examiner*—Steve Alvo

*Attorney, Agent, or Firm*—Dirk J. Veneman; Raymond W. Campbell; Gerald A. Mathews

[57] ABSTRACT

Method and apparatus are provided for effectively controlling cross-machine moisture profile in a paper web undergoing processing, such as water-removal via a press nip. A compartmentalized system is provided in close proximity across a section of a traveling web undergoing dewatering whereby select size cross-machine compartments, for example, about 6" in width, are selectively provided with steam and/or air so as to control wet and/or dry streaks along the traveling web so that web areas opposite each compartment can be selectively heated for accentuated moistre removal or cooled for retarded water removal. In preferred embodiments, control of the profiling system occurs with the air of moisture sensors and a computer.

7 Claims, 1 Drawing Sheet

PROFILING AIR/STEAM SYSTEM FOR PAPER-MAKING MACHINES

This application is a continuation of application Ser. No. 06/720,482 filed Apr. 9, 1985, now abandoned, which is a continuation-in-part of application Ser. No. 06/428,565 filed Sept. 30, 1982, now abandoned.

BACKGROUND OF THE INVENTION

The invention relates to improved paper-making machines and somewhat more particularly to improved means for effective control of cross-machine moisture profile in a traveling paper web undergoing dewatering, as in a press section.

PRIOR ART

Methods and mechanisms for applying steam to aid in dewatering a paper web are known, for example, see U.S. Pat. No. 4,272,316 or U.S. Pat. No. 4,163,688.

A presently accepted theory for this technique is that as a paper web or sheet is heated by applied steam, the viscosity of water in such web is reduced, making water removal easier. Recent developments in this area include compartmentalized steam boxes having separate cross-machine compartments allowing steam to be selectively applied in the cross-machine direction to a traveling web. Typically, such steam boxes are positioned about the outer surface of a suction roll so that steam can be drawn into the suction box and through the web supported by such roll. The ability to correct or control the cross-machine moisture profile in a web has met with various degrees of success and problems still remain. One of such problems is that each compartment cannot be readily sealed against the surface of the traveling web. One reason for this is that a minimum clearance of about 1" between the surface of the steam box and the suction roll must be maintained in order to avoid damages from wads, wrap-ups, etc. With such large clearances, much of the applied steam in one compartment is free to migrate to adjacent compartments, with a resultant indiscriminate application of steam.

Steamboxes currently in use have several compartments in which steam can be applied to the sheet to control the cross-machine direction moisture profile. None of these boxes, however, uses air. Instead, they either use labyrinth baffles or steam curtains to keep air away from the sheet. It has been commonly believed that air would have a detrimental effect on sheet dryness.

Prior art steamboxes attempt to correct the moisture profile by supplying steam to those areas of the sheet which were higher in moisture. This steam would serve to heat the sheet in that area and improved water removal during pressing. The same steamboxes might attempt to increase the overall pressing effect by adding additional steam across the entire width of the machine. In order to avoid any loss in pressing improvement from this additional steam, the aforementioned labyrinths and steam curtains were used to exclude air. As a result of such efforts to exclude air, the conventional steamboxes are capable only of "one-direction" profiling; i.e., the moisture content can be lowered by supplying more steam, but it cannot be raised by cooling the sheet.

In addition, when the steam flow is decreased in the low moisture areas, the steam from adjacent profiling and heating sections migrates into the low-flow area.

These migratory flows not only keep the sheet area from maintaining its original temperature, but also produces a loss in discreteness of profile control. Furthermore, whatever air is drawn into the steambox must come from the immediate surroundings. On a commercial machine, this air is generally very humid and hot. As a result, it is limited in the amount of cooling it could accomplish.

SUMMARY OF THE INVENTION

The invention provides a method and means which overcomes the prior art drawbacks and provides a more effective control of cross-machine moisture profile in a traveling paper web undergoing moisture removal in a paper-making machine.

In preferred embodiments of the invention, a compartmentalized system, such as in a chamber, is provided in working relation with a traveling paper web undergoing dewatering, as in a paper-making machine press section. This system includes a plurality of cross-machine profiling areas of compartments, each having valve-controlled means selectively supplying relatively dry air and/or steam to the web area associated with each profiling area.

In an exemplary embodiment of the invention, a steam box having a plurality of cross-machine compartments is positioned in close-running relation to a fluid-permeable means supporting a traveling web, typically a press nip defined by two press members, such as press rolls, one of which can be a grooved roll or a suction roll. The steam box is provided with a first cross-machine header, connected to a steam supply in the paper-making machine. Exiting from such header is a plurality of supply pipes and control valves, each associated with an individual compartment of the steam box. In addition, the steam box is provided with a second cross-machine header, connect to a compressed air source in a paper-making machine, with supply pipes and control valves associated therewith and with each individual compartment.

In preferred embodiments, a single valve means controls both the steam and air flow to an individual compartment. Each valve means can be interconnected to a computer and moisture sensors can be associated with select transverse areas of a traveling web and be interconnected to the computer so that the valves are appropriately activated by the computer for steam and/or air flow in accordance with the signal generated by the sensors.

In accordance with the principles of the invention, the air supply can be used to "flood" a compartment so as to prevent cross-machine migration of steam into that area. Selectively supplying dry air to a select compartment of a steam box is further advantageous in that it can be utilized to control dry areas of a sheet. As air is drawn into a sheet, evaporation cooling occurs, reducing the sheet temperature. At lower sheet temperatures, pressing is less effective. Hence, steam is supplied to control wet streaks in a sheet and air is supplied to control dry streaks in a sheet.

As the air is drawn through the web, it is exhausted through a roll. The air serves to alter the pressing effect rather than a thermal drying effect.

The air cools the web by means of an adiabatic-saturation process, rather than heat the web. The heat exchange between the air and the web occurs by intimate contact as the air flows through the web rather than by air which impinges on the web.

The new steambox uses air to augment both the profiling range and the profiling accuracy. This is accomplished by supplying cool, dry air directly to the chambers over the low moisture content areas of the sheet while supplying saturated or nearly saturated steam directly to the chambers over the areas of the sheet of high moisture content, and by modulating the steam/air flow ratio to provide intermediate range control. The total volume flow to each chamber, regardless of its steam/air ratio is kept essentially equal across the machine width. The air used in accordance with this invention thus depresses the web temperature and maintains profiling discreteness.

Other objects, advantages and features as well as equivalent structures and methods which are intended to be covered herein will become more apparent with the teachings of the principles of the present invention in connection with the disclosure of the preferred embodiments thereof in the specification, claims and drawings, in which:

DESCRIPTION OF THE PREFERRED EMBODIMENTS

Figure 1:
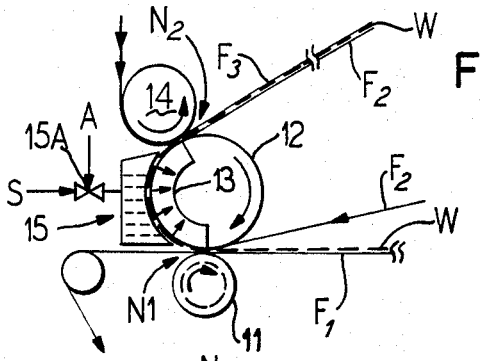
FIG. 1 is a schematic elevational partial view illustrating a section of a paper-making machine constructed and operating in accordance with the principles of the invention.

As illustrated in FIG. 1, a newly formed web W is carried on the upper surface of a traveling first endless felt, F1, for example, from a Fourdrinier machine or from a first press section (not shown), into a press nip N1 defined between a lower grooved roll 11 and an upper suction roll 12. A traveling second endless felt F2 is guided by guide rolls (not shown), so as to sandwich the web W between the felts F1 and F2 as they pass through the press nip N1. At the press nip N1, water is removed downwardly into the grooved roll G and from there to a saveall in a conventional manner. On the off-running side of the nip N1, the web W adheres to the second felt F2 as this felt travels around the suction roll 12 in the manner shown. The first felt F1 is guided away from the press nip N1 by a suitable guide roll and back through its endless loop in a conventional manner. The second felt F2, carrying the web W on its outer surface, travels around the suction roll 12 and past the suction gland 13 as illustrated. A profiling steam/air box 15 is positioned in close working relation with the outer surface of the suction roll 12 so as to feed air or steam to select areas of the web via a control valve 15A connected to a steam source S and to an air source A. The supplied steam and/or air streams penetrate through the felt F2 and into the web W and thence into the suction gland 13 of the suction roll 12 to effect temperature control of the associated areas of the web. A plain-surfaced press roll 14 is positioned above suction roll 12 so as to define a second nip N2. A third endless traveling felt F3 is guided over the surface of the plain press roll and against the web W so as to sandwich the web between the felts F2 and F3. The so-sandwiched web is then carried away for further processing, for example, to another press section or to a dryer section of a paper-making machine.

Figure 2:
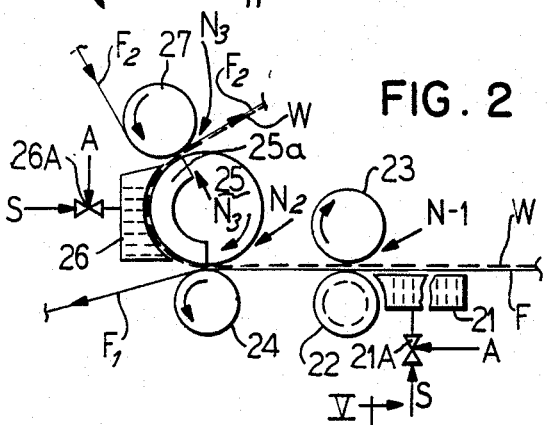
FIG. 2 is another somewhat similar schematic elevational view showing another form of the invention.

FIG. 2 shows another press section wherein the profiling air/steam box of the invention is advantageously employed. In the embodiment here illustrated, a newly formed web W is carried on a top surface of a first endless felt F1 into a first press nip N1 defined by an upper plain roll 23 and a lower grooved roll 22. just prior to the press nip N1, a compartmentalized profiling air/steam box 21 is positioned in close running relation with the felt F1 so as to selectively feed steam and/or air upwardly through the felt F1 and into the web W via control valve 21A. At this location, steam aids water removal while dry air retards water removal so that steam can be supplied to control wet streaks in the newly formed web or sheet and air can be supplied to control the dry areas thereof. After the press nip N1, the felt F1 carries the web W into a second press nip N2 defined by a lower plain roll 24 and an upper suction roll 25 having a suction gland 25*a*. On the off-running side of the nip N2, the felt F1 is guided away from the web W back through its endless run via a pluraity of guide rolls (not shown). The web W continues to adhere to the outer surface of the suction roll 25 because of the suction gland 25*a*. A second profiling air/steam box 26 is positioned in close running relation with the outer surface of the suction roll in close conformity with the suction gland 25*a* and selectively feeds air or steam in a substantially constant volume flow but with a controllable ratio between the two against the web surface via control valve 26*a*. Heated water is move readily withdrawn from the web via the suction gland whereas cooled water (cooled by supplied air) is somewhat more difficult to withdraw so that control of wet and/or dry streaks in the web W can be readily accomplished. A second endless traveling felt F2 is guided around a further plain press roll 27 positioned to define a further press nip N3 with the suction roll 25. On the off-running side of the nip N3, the felf F2 carries the web W on its undersurface away for further processing as desired.

The profiling steam/air boxes of the invention, such as boxes 21 and 26, correct cross-machine moisture profiles in webs undergoing dewatering. Each steam box is relatively fluid impermeable except for an open front face and is divided into a number of compartments in the cross-machine direction. Cross-machine headers are provided to supply compressed steam and air, respectively, to each compartment, which also includes an individual control valve. As is known, paper-making machines typically include a source of pressurized steam and may include a source of pressurized air. In any event, relatively dry air can be supplied from an external source by a fan or other suitable means. A select air steam can be used to flood a compartment to prevent cross-machine migration of steam into the flooded compartment. Further, such dry air stream provides a means of controlling dry areas of a sheet since as air is drawn into a sheet, evaporation cooling occurs reducing the sheet temperature, making water removal less efficient. In this manner, dry areas can be controlled and by selectively applying steam to other areas, wet streaks can be controlled.

Figure 3:
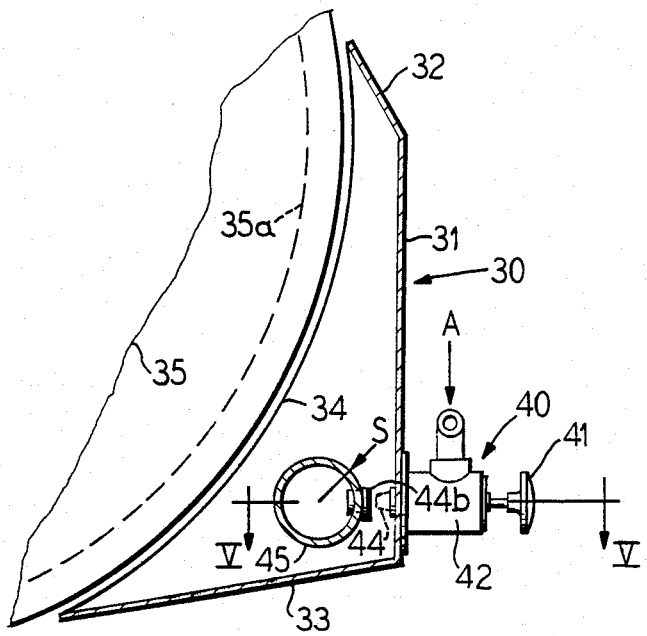
FIG. 3 is a partial somewhat schematic elevational view illustrating a steam/air box of the invention in association with a grooves press roll.
Figure 4:
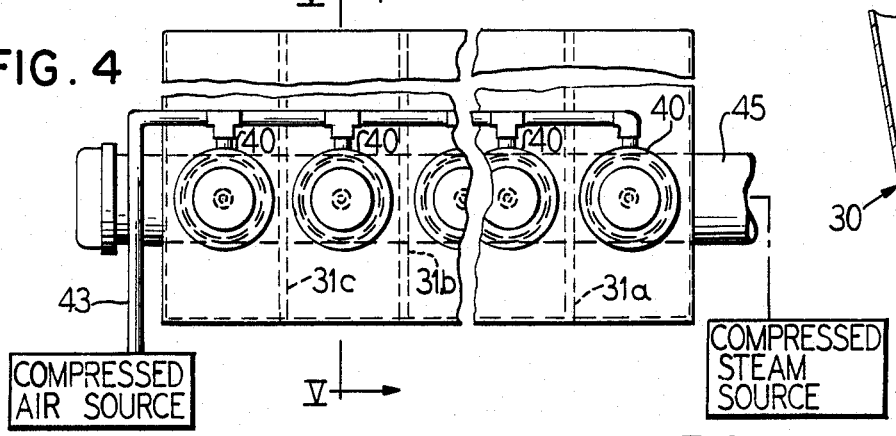
FIG. 4 is a partially broken-away top view illustrating one form of header arrangements utilized to supply air/steam to the air/stream box of the invention.
Figure 5:
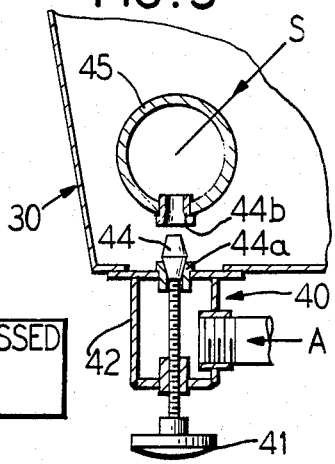
FIG. 5 is an elevated detailed view of a valve arrangement utilized to control steam/air in the air/steam box of the invention.

Referring to FIG. 3, a grooved roll 35 having a plurality of grooves 35*a* is shown positioned in working relation with a profiling and/or steam box 30. The box 30 is provided with a back wall 31, an upper wall 32, a lower wall 33 and a forward open face 34, along with appropriate end walls (not shown), all joined together in a relatively fluid-tight manner so as to be able to direct the steam and/or air flow toward the front face 34 of the box 30. The walls are preferably formed from sheet metal and a plurality of individual compartments, for example, about 6" in width, are provided along the cross-machine direction of the box. For this purpose, a plurality of compartment walls 31*a*, 31*b*, 31*c*, etc. are suitably secured between the upper and lower walls 32 and 33 of the box, as shown at FIG. 4. Each compartment is provided with a control valve 40 suitably interconnected with an air supply A and a steam supply S. The air supply is connected with an air feed line 43 and the steam supply is connected with a steam feed line 45. The valve means 40 include a hollow body 42 and a valve stem 41 which carries a double-truncated conical valve body 44 mating with respective valve seats 44*a* and 44*b*. Valve seat 44*a* is formed at the upper portion of valve body 42 while valve seat 44*b* is formed within the steam pipe 45. By selectively moving the valve stem 41 either the valve seat 44*a* can be shut while valve seat 44*b* can be opened, as shown in FIG. 5 or the stem may be moved upwardly to shut the steam supply pipe by blocking valve seat 44*b* while opening the air supply valve seat 44*a*. As best seen at FIG. 4, the compressed air source and steam sources are respectively connected to headers which interconnect with the respective valve means associated with each compartment. The valves are so positioned away from the front face 34 that a pressurized stream of air/steam cannot directly impinge on a surface adjacent the open face.

Figure 6:
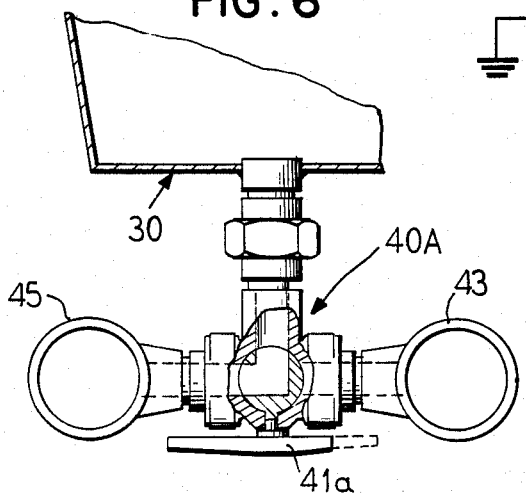
FIG. 6 is an elevated detailed view of an alternative valve arrangement utilized in the practice of the invention.

FIG. 6 shows an alternate embodiment of a control valve useful in the practice of the invention. As shown, a ball valve 40A is provided for connecting the steam feed pipe 45 with the box 30 and with the air feed line 43. Movement of the valve steam 41*a* allows either steam or air to flow through the valve housing into the steam box 30.

Figure 7:
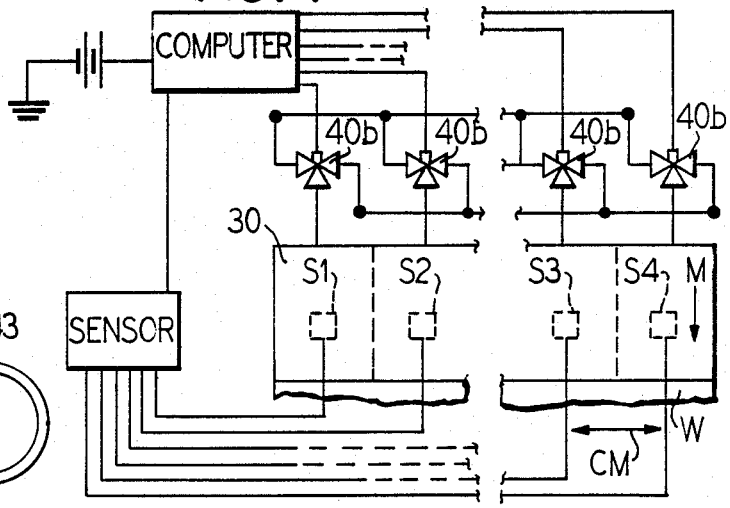
FIG. 7 is a schematic diagram illustrating a working relation between a computer, moisture sensors and respective valve means of an air/stream box constructed and operable in accordance with the principles of the invention.

Referring now to FIG. 7, a portion of a web W is shown traveling in the machine direction M and extending in a cross-machine direction CM of a paper-making machine. A plurality of moisture sensors S1, S2, S3, S4, etc. are positioned in working relationship with the web W and the steam/air box 30, with each sensor associated with a select cross-machine area of the web. Each sensor senses the moisture level in its given area of the web and generates a signal which is fed to an operational computer. The computer is electrically connected to a plurality of solenoid-operated valves 40*b*, each associated with a given compartment of profiling box 30. In this manner, in accordance with the signal received from the sensors, the computer opens or closes valves 40*b* to admit steam or relatively dry air to the particular compartment.

Normally, a sheet entering the press section is at a temperature of 100° to 120° F. A steambox is capable of increasing this temperature to a maximum of 212° F. Typically, the maximum sheet temperature which can be obtained is about 180° F. If hot, humid air were allowed to contact the sheet where no labyrinth seals or steam curtains are present, the sheet would tend to cool. For example, if air were at 110° F. and a relative humidity of 80%, typical of a press section, the lowest obtainable temperature would be the adiabatic saturation limit of 104° F. However, if cool dry air were supplied to the same area of the sheet, the adiabatic saturation limit would decrease substantially. If the air were at 80° F. and 30% RH, the low temperature limit would be reduced to 60° F. The range in temperature is therefore increased from the range of 104° to 180° F. to the range of 60° to 180° F. Thus, the profiling control range is increased because dry streaks can be cooled by the air while adjacent wet streaks can be heated by the steam. This additional range is achieved by (1) accurately displacing steam that would otherwise migrate into the zone if there were no air present and (2) cooling the sheet both through adiabatic saturation cooling and by direct convective cooling as the cool dry air contacts the warm, wet sheet.

In order to produce accurate and discrete control of the sheet temperature and moisture, it is necessary to contain the steam in the area to which it is supplied. That is, the steam which is supplied to one chamber of the steambox must not be allowed to migrate into adjacent chamber areas. Similarly, the air must be kept from migrating away from its chamber area. Sealing strips may be placed under the steambox between the various chamber areas to keep the steam and air flows separated. However, they might also interfere with efficient and clean operation, serving to collect debris. Instead, fluid pressure balance is used to keep the chamber flows separated. Equal volume flows are provided to each chamber so that no single chamber is "starved" and so draws steam and/or air from adjacent areas.

Some test results using the improvements of the present invention are shown in Table 1. There was achieved a 1.4% sheet dryness decrease using air and a 1.1% dryness increase using steam.

Table 2 shows the results from another set of tests, run on a different furnish. These tests show an average of 0.6% moisture decrease even though the supplied air temperature was never more than 4° F. lower than the sheet temperature. The profiling discreteness was also investigated to show the improvement made possible by using air. In these tests, the temperature of the felt was measured as an indication of the effect the steambox would have on a sheet of paper.

With steam flowing in the outside compartments and no flow in the center compartment, the temperature dropped, but steam was definitely flowing into the zone from both sides. This cross-machine direction flow shifted the control zones inward and caused air to be drawn in from the edges of the box, decreasing the temperature gradients. The addition of air to the center compartment broadened the zone from a temperature dip to a four inch, wide region, lowered the center zones lowest temperature by 10° F. and increased the temperature gradients between center and outside zones. Gradients as high as 54° F. per inch and adjacent zone temperature differences of up to 70° F. were achieved.

To take advantage of these benefits, air should be mixed with steam to keep the total flow in each compartment constant across the whole machine. Dryness can then be controlled by using different ratios of steam and air to heat and cool the sheet as required. An improved steambox of this type should have a profiling range of up to 5% change in dryness and evidence much more accurate control of the moisture profile as compared with conventional steamboxes.

TABLE 1

| | | | | STEAM-AIR BOX TEST | | | | | |
|---|---|---|---|---|---|---|---|---|---|
| TIME | PAPER TEMP. (°F.) | ΔT (°F.) | % DRY | °F./1% | FLOW | lb/FLOW lb/FIBER | ΔDRY (%) | BASIS WEIGHT (lb/3000 ft$^2$) | SPEED (FPM) |
| 11:08 | 92.3 | 0 | 40.1 | 0 | — | | 0 | 83.2/3000 ft$^2$ | 2722 |
| 11:15 | 116.4 | 24.1 | 41.2 | 21.9 | Steam | .082 | 1.1 | | |
| 11:25 | 85.4 | −6.9 | 38.7 | 4.9 | Air | .304 | −1.4 | | |

FURNISH: 100% Softwood Roll-Stock from Weyerhaeuser - once dried.

TABLE 2

| TIME | AIR FLOW (lbs/hr) | lbs/FLOW lbs/FIBER | PAPER TEMP (°F.) | ΔT (°F.) | % DRY | Δ% DRY |
|---|---|---|---|---|---|---|
| 11:25 | 794.7 | .462 | 84.2 | 2.7 | 39.9 | −.8 |
| 11:29 | 837.6 | .487 | 82.3 | .8 | 33.0 | −7.7 |
| 11:33 | 856.5 | .498 | 82.2 | .7 | 40.3 | −.4 |
| 11:36 | 871.2 | .507 | 82.2 | .7 | 40.2 | −.5 |

FURNISH: Newsprint Broke, 30 lbs/3000 ft$^2$
SPEED: 2000 FPM

Thus, it will be seen that we have provided an improved method and apparatus for more effective control of the cross-machine moisture profile of a paper web, particularly in conjunction with a press section of a paper-making machine which meets the objectives and advantages above set forth and accentuates moisture removal in wet areas of a web while retarding water removal in dry areas thereof.

We claim as our invention:

1. An apparatus for effective control of cross-machine moisture profile of a paper web in a papermaking machine, in combination:

fluid permeable pressure roll means supporting a travelling paper web undergoing press nip dewatering;

a compartmentalized steam box or air box or steam and air box positioned in working relation with said pressure roll means, said box extending in a cross-machine direction substantially across the width of said paper web and having an open front face in fluid communication with said pressure roll means and being positioned in relatively close proximity thereto, said box having a plurality of separate compartments, each in fluid communication with said front face and each having individually controllable steam and air outlets located away from said front face, so as to selectively allow a stream of steam or air in adjustable amount to flood each respective compartment and permeate a discrete, predetermined corresponding area of the paper web over said pressure roll means;

a single control valve means in fluid communication with each compartment and operatively associated with a source of pressurized steam having a temperature higher than that of the web and means for supplying the pressurized steam and a source of compressed air having a temperature lower than that of the web and means for supplying the compressed air, and said steam and air outlets in each compartment, wherein said single valve means opens one of the means for supplying pressurized steam and the means for supplying compressed air while the other one is being closed to selectively control the proportions of steam and air in each compartment and maintain the total amount of steam or air or mixture of both in each compartment substantially the same;

means for drawing air through said web and for exhausting the air after the air has partially cooled the web, said air altering the pressing effect of said web while on said pressure roll means by means of cooling the web by adiabatic saturation; and a water-removal means positioned in working relation with said compartmentalized box for removing water from said paper web.

2. An apparatus as set forth in claim 1, wherein:

the water-removal means includes a press nip formed between a first press member and a second press member defining a pressing zone therebetween through which said paper web is carried;

the first press member is a plain-surfaced press roll and the second press member is a grooved press roll.

3. An apparatus as set forth in claim 1, wherein:

the water-removal means includes a press nip formed between a first press member and a second press member defining a pressing zone therebetween through which said paper web is carried;

the first press member is a suction press roll and the second press member is a plain-surface roll.

4. The apparatus as set forth in claim 1, wherein:

the pressure roll means includes a pair of press nips formed between a lower plain-surfaced press roll, an intermediate suction press roll, and an upper plain-surface press roll, each of said plain-surfaced press rolls defining an individual pressing zone with said suction press roll through which said paper web is successively carried and subjected to dewatering pressure;

the means for drawing air through said web and for exhausting the air comprises a suction gland within the suction press roll;

the compartmentalized steam box or air box or steam and air box is positioned in working relation with the suction gland of the suction press roll between the respective press nips formed by the plain-surfaces press rolls and the suction press roll.

5. The apparatus as set forth in claim 1, wherein:

the valve means includes a hollow valve housing having an upper wall, a lower wall and side walls joined in a relatively fluid-tight manner, said air outlet being in fluid communication with said hollow valve body, a movable valve stem threadingly supported along the bottom wall of said valve housing and carrying a double-truncated conical valve body at an outer end thereof, said first valve seat formed in an upper wall of said valve body and mating with a first end of said valve body, said first valve seat being in fluid communication with the associated compartment, and a second valve seat spaced from said first valve seat and formed in an outer wall of said steam outlet and mating with a second end of said valve body whereby pressurized steam from said steam outlet is directed through said second valve seat against said second end of said valve body and pressurized air is directed through said first valve seat against said first end of said valve body so as to permeate the compartment associated with said valve means, with steam or air or a mixture thereof in accordance with the position of said valve body.

6. The apparatus as set forth in claim 1, wherein:

the valve means comprises a ball valve in selective fluid communication with the steam and air sources, and with a given compartment of the steam box or air box or steam and air box and includes an actuating means for selectively providing communication between the steam and air, or steam, or air, source and the compartment.

7. The apparatus as set forth in claim 1, wherein:

the valve means comprises a solenoid valve;

a plurality of moisture sensors are provided in working relation with selected cross-machine areas of the paper web corresponding to a compartment of the steam box or air box or steam and air box;

a computer is connected with the pressure sensors and with each of the solenoid valves so that during operation, the moisture sensors feed a signal to the computer in accordance with the moisture level in a paper web area being monitored by each such sensor and the computer modifies the flow of steam or air into each compartment in accordance with the signal.

* * * * *